US009079405B2

(12) United States Patent
Kurosu et al.

(10) Patent No.: US 9,079,405 B2
(45) Date of Patent: Jul. 14, 2015

(54) LIQUID EJECTION HEAD AND METHOD FOR MANUFACTURING THE SAME

(71) Applicant: CANON KABUSHIKI KAISHA, Tokyo (JP)

(72) Inventors: Toshiaki Kurosu, Oita (JP); Hiroto Komiyama, Tokyo (JP); Jun Yamamuro, Yokohama (JP); Yoshinori Tagawa, Yokohama (JP); Takanobu Manabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/295,504

(22) Filed: Jun. 4, 2014

(65) Prior Publication Data

US 2014/0368579 A1 Dec. 18, 2014

(30) Foreign Application Priority Data

Jun. 12, 2013 (JP) ..... 2013-123747

(51) Int. Cl.
*B41J 2/14* (2006.01)
*B41J 2/16* (2006.01)

(52) U.S. Cl.
CPC ..... *B41J 2/1603* (2013.01); *B41J 2/1628* (2013.01); *B41J 2/1629* (2013.01); *B41J 2/1631* (2013.01); *B41J 2/1632* (2013.01); *Y10T 29/49401* (2015.01)

(58) Field of Classification Search
CPC ..... B41J 2/1433; B41J 2/162; B41J 2002/14419; B41J 2002/20; B41J 2/145
See application file for complete search history.

(56) References Cited

U.S. PATENT DOCUMENTS

| | | | | |
|---|---|---|---|---|
| 5,478,606 | A | 12/1995 | Ohkuma et al. | |
| 7,140,717 | B2 * | 11/2006 | Silverbrook | 347/40 |
| 7,287,847 | B2 | 10/2007 | Fujii et al. | |
| 7,300,596 | B2 | 11/2007 | Murayama et al. | |
| 8,091,234 | B2 | 1/2012 | Ibe et al. | |
| 8,148,049 | B2 | 4/2012 | Murayama et al. | |
| 8,177,988 | B2 | 5/2012 | Komiyama et al. | |
| 8,197,705 | B2 | 6/2012 | Kishimoto et al. | |
| 8,251,492 | B2 * | 8/2012 | Kim et al. | 347/47 |
| 8,613,862 | B2 | 12/2013 | Asai et al. | |
| 8,870,346 | B2 * | 10/2014 | Kimura | 347/47 |
| 8,936,351 | B2 * | 1/2015 | Misawa et al. | 347/47 |
| 2010/0149283 | A1 | 6/2010 | Miyazaki | |
| 2012/0325772 | A1 | 12/2012 | Miyazaki | |

FOREIGN PATENT DOCUMENTS

| | | | |
|---|---|---|---|
| JP | 06-286149 | A | 10/1994 |
| JP | 2010-162874 | A | 7/2010 |

* cited by examiner

*Primary Examiner* — Lamson Nguyen
(74) *Attorney, Agent, or Firm* — Fitzpatrick, Cella, Harper & Scinto

(57) ABSTRACT

A liquid ejection head chip includes a liquid ejection unit having a plurality of ejection orifices for ejecting a liquid, a flow path in communication with the ejection orifices, and an energy generating element that generates energy for ejecting the liquid, the liquid ejection unit being provided on an upper surface formed of a (100) surface of a silicon single-crystal substrate. The side surfaces in at least one of two combinations of opposing side surfaces of the substrate have (111) surfaces of silicon single crystal and the angles of the (111) surfaces relative to the (100) surface are supplementary to each other.

4 Claims, 3 Drawing Sheets

LIQUID EJECTION HEAD AND METHOD FOR MANUFACTURING THE SAME

BACKGROUND OF THE INVENTION

1. Field of the Invention

The present invention relates to a liquid ejection head having a rectangular chip shape, which is ideally suited for accurately forming a liquid ejection chip row, and a method for manufacturing the same.

2. Description of the Related Art

As an example of a liquid ejection head that ejects a liquid, there is an ink-jet recording head used with an ink-jet printing system adapted to eject droplets of an ink and attach the ink droplets onto a medium to be printed, such as paper.

As recording technologies have become more advanced in recent years, ink-jet recording heads have been required to achieve higher arrangement densities of ejection orifices through which inks are ejected and higher accuracy of the configurations of ejection orifices and flow paths in communication with the ejection orifices. For example, according to the manufacturing method of ink-jet recording head disclosed in Japanese Patent Application Laid-Open No. H06-286149, a coating resin layer which uses a resin patternable by photolithography and which will provide ink flow path walls is deposited on a silicon wafer provided beforehand with heating elements and drive circuits, and then ink ejection orifices are formed in the coating resin layer.

As a method for manufacturing a conventional full-line type ink-jet recording head, there is a method in which the end surfaces of a plurality of recording element substrates made of silicon or glass are linearly butted against each other to arrange the plurality of recording element substrates. However, according to the method for manufacturing the full-line type ink-jet recording head as described above, the recording element substrates are arranged by a butting method. This may pose a problem in that, if there are variations in the cutting accuracy of recording element substrates, then the variations directly lead to variations in the placement accuracy of ejection orifices.

As a solution to the aforesaid problem, a method for improving the placement accuracy of ejection orifices has been disclosed in Japanese Patent Application Laid-Open No. 2010-162874. According to the method disclosed in Japanese Patent Application Laid-Open No. 2010-162874, a surface which is provided as a part of a side surface in the longitudinal direction of a rectangular-parallelepiped-shaped recording element substrate and which is processed by dry etching or anisotropic silicon etching with an alkali solution is used as the surface for butting the recording element substrate against another recording element substrate.

SUMMARY OF THE INVENTION

An object of the present invention is to provide a liquid ejection head chip having an outer periphery shape that makes it possible to arrange an ejection orifice array surface of each liquid ejection head chip with high placement accuracy when directly butting a plurality of liquid ejection head chips to arrange the liquid ejection head chips in series for a full-line type, and a method for manufacturing the liquid ejection head chip.

A liquid ejection head chip in accordance with the present invention includes: a liquid ejection unit having a plurality of ejection orifices for ejecting a liquid, a flow path in communication with the ejection orifices, and an energy generating element that generates energy for ejecting the liquid, the liquid ejection unit being provided on an upper surface composed of a (100) surface of a silicon single-crystal substrate, wherein side surfaces in at least one combination of two combinations of opposing side surfaces of the substrate have (111) surfaces of silicon single crystal and the angles of the (111) surfaces relative to the (100) surface are supplementary to each other.

A method for manufacturing a liquid ejection head chip in accordance with the present invention is a method for manufacturing a liquid ejection head chip in which a liquid ejection unit having a plurality of ejection orifices for ejecting a liquid, a flow path in communication with the ejection orifices, and an energy generating element that generates energy for ejecting the liquid is provided on an upper surface composed of a (100) surface of a silicon single-crystal substrate, the method including the steps of:

(a) building a chip array, which is formed of the liquid ejection head chips arranged, onto the upper surface formed of the (100) surface of a common substrate composed of silicon single crystal; and (b) dividing each liquid ejection head chip apart from the chip array provided on the common substrate such that opposing side surfaces of the liquid ejection head chip are formed of (111) surfaces of the silicon single crystal and the angles of the opposing surfaces relative to the (100) surface are supplementary to each other, thereby obtaining the liquid ejection head chip, wherein the step (b) includes the steps of:

(b-1) providing an etching mask pattern for forming one of the opposing side surfaces of each of the liquid ejection head chips, which constitute the chip array, on the upper surface of the common substrate and carrying out anisotropic etching from the upper surface of the common substrate to form the (111) surface, at a position where the one of the opposing side surfaces is to be formed, in the direction of the thickness of the common substrate;

(b-2) providing an etching mask pattern for forming the other of the opposing side surfaces of each of the liquid ejection head chips, which constitute the chip array, on a lower surface of the common substrate and carrying out anisotropic etching from the lower surface of the common substrate to form the (111) surface, at a position where the other of the opposing side surfaces is to be formed, in the direction of the thickness of the common substrate; and (b-3) cutting the common substrate at a position in the (111) surface obtained by the steps (b-1) and (b-2), at which position surfaces having the angles relative to the (100) surface that are supplementary to each other will remain, thereby obtaining side surfaces composed of the opposing (111) surfaces.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Using a full-line type liquid ejection head is advantageous in that placing the liquid ejection head across the entire horizontal width of a recording medium, such as recording paper, makes it possible to accomplish recording in a horizontal width direction in a single recording operation without scanning the liquid ejection head in the horizontal width direction of the recording medium. To fabricate such a full-line type liquid ejection head, a plurality of liquid ejection head chips, which are substantially rectangular-parallelepiped-shaped, are arranged by directly butting them, thereby permitting a higher arrangement density of the liquid ejection head chips in the liquid ejection head with consequent improved arrangement efficiency.

However, when the side surfaces of the liquid ejection head chips are directly butted against each other to arrange them in series, the accuracy of the machined surfaces of the butted portions significantly influences the placement accuracy of ejection orifices after the series placement. Technologically, therefore, an extremely high machining accuracy is required for the butting surfaces when the liquid ejection head chips are placed.

Figures 1, 3A:
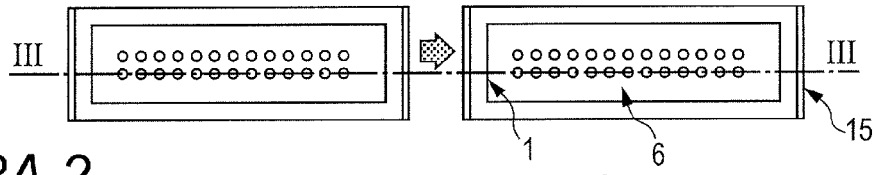
FIGS. 3A-1, 3A-2, 3A-3, 3B-1, 3B-2, 3B-3, 3C-1, and 3C-2 are diagrams illustrating the process for bonding the liquid ejection head chips.
Figures 2, 3A:
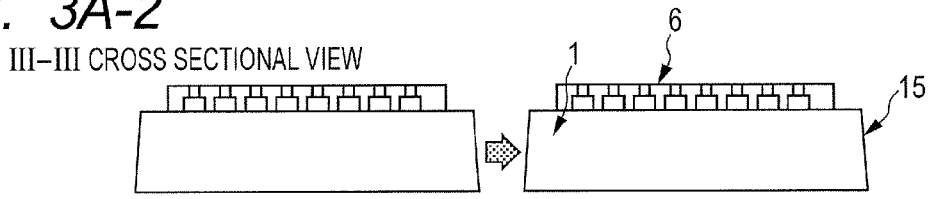

In the case where liquid ejection head chips are placed in series in a longitudinal direction, as illustrated in the plan view of FIG. 3A-1, the face surfaces of the liquid ejection heads are preferably arranged in the same plane with high accuracy. Regarding the placement of the face surfaces of the liquid ejection heads, the surface accuracy of a butting surface 15 of each liquid ejection head chip influences the placement accuracy of the ejection orifices after the placement. For example, as illustrated by sectional views III-III of FIG. 3A-2 and FIG. 3A-3, a difference in the angle of inclination between the side surfaces of the liquid ejection head chips to be butted against each other leads to variations in the setting levels at the positions of the ejection orifice layout surfaces (face surfaces) of the liquid ejection head chips. The difference in the setting positions of the face surfaces may result in a difference between the face surfaces in the ejecting direction of an ink ejected from the face surfaces with consequent irregularities in images to be printed.

Meanwhile, as a method for manufacturing liquid ejection head chips, there has been known a method in which many liquid ejection head chips are built in a silicon wafer serving as a common substrate and dividing the liquid ejection head chips to take individual separate liquid ejection head chips out of the silicon wafer. When dividing and taking the liquid ejection head chips out of the silicon wafer, carrying out anisotropic dry etching or wet etching to cut the individual liquid ejection head chips apart permits improved plane accuracy of cut surfaces.

Figures 3, 3A:
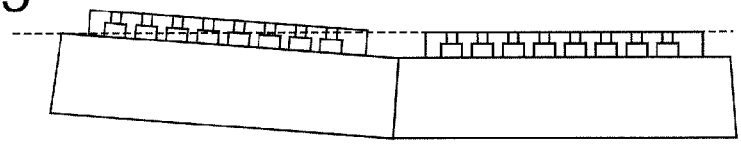

However, when forming the side surfaces of the liquid ejection head chips by dry etching, there are cases where a phenomenon called loading effect, in which the supply amount of a gas differs between a central portion and an outer peripheral portion of a silicon wafer, occurs in a standard reactive ion etching process. If the loading effect occurs, then the etching rate differs between the central portion of the silicon wafer and the outer peripheral portion of the silicon wafer, resulting in a difference in the angle of inclination in the vertical direction of a side surface of each liquid ejection head chip. For example, the difference in the angle of inclination is approximately a few degrees in some cases, depending on etching conditions. If liquid ejection head chips having such variations in the angles of inclination of the side surfaces are directly butted to be arranged in series, then a problem of deteriorated placement accuracy of the face surfaces as illustrated in FIG. 3A-3 is caused.

The liquid ejection head chip in accordance with the present invention has a configuration in which a liquid ejection unit is provided on an upper surface, i.e. a face surface, of a substrate formed of silicon single crystal. The liquid ejection unit has at least ejection orifices for ejecting a liquid, flow paths in communication with the ejection orifices, and energy generating elements that generate energy for ejecting the liquid. The specific constructions and installation positions of the constituent elements are not particularly limited insofar as the surface accuracies and the shapes of the substrate side surfaces desired in the present invention can be obtained. Further, as will be described in an embodiment hereinafter, a configuration may be adopted, in which a liquid supply port is provided in the lower surface (the back surface) of a substrate to supply a liquid to the ejection orifices provided in the upper surface of the substrate.

As the substrate, a single-crystal silicon substrate having a (100) crystal orientation is used. In the substrate, the upper surface and the lower surface, which are parallel to each other, are rectangular (100) surfaces. A liquid ejection unit is built in the upper surface of the substrate, and opposing side surfaces are formed to be (111) surfaces such that the opposing side surfaces have angles that are supplementary to each other. Thus, using these side surfaces as the surfaces to be directly butted against each other makes it possible to accurately arrange the liquid ejection head chips.

The substrate has two combinations of opposing side surfaces. Forming the side surfaces of at least one of the combinations to have the configuration described above allows the side surfaces to be used as the portions to be directly butted.

An example of the liquid ejection head chip in accordance with the present invention will be described with reference to FIG. 1A to FIG. 1C.

Figure 1A:
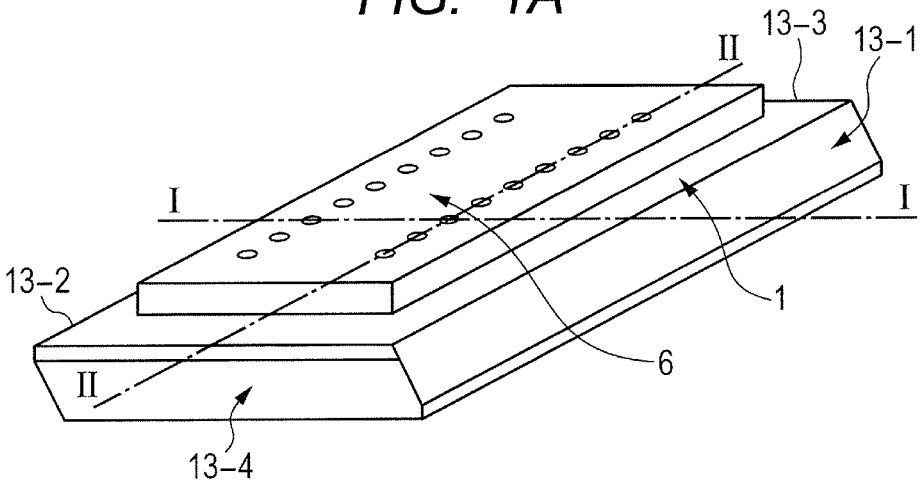
FIGS. 1A, 1B, and 1C are diagrams illustrating an example of a liquid ejection head chip in accordance with the present invention.
Figure 1B:
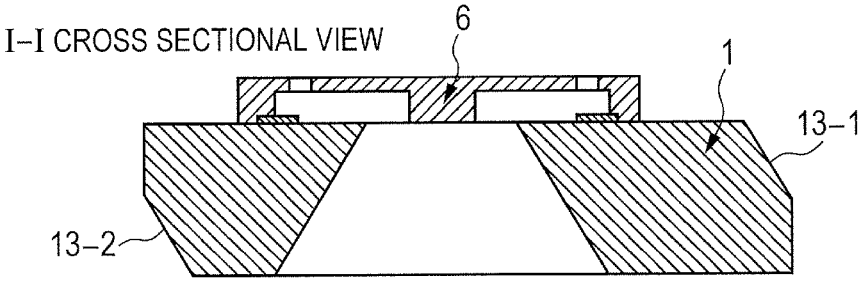
Figure 1C:
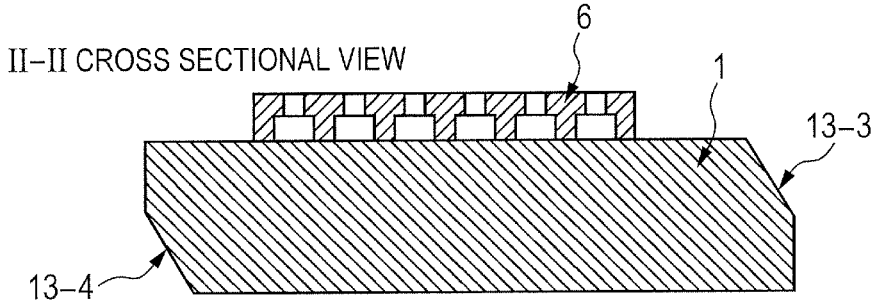

FIG. 1A to FIG. 1C present schematic diagrams illustrating an example of the liquid ejection head chip in accordance with the present invention. FIG. 1A is a perspective view of the liquid ejection head chip in accordance with the present invention, FIG. 1B and FIG. 1C are cross sectional views of the liquid ejection head chip illustrated in FIG. 1A, which are taken vertically along I-I and II-II, respectively. As illustrated in FIG. 1A, the liquid ejection head chip is provided with an ejection orifice member 6 having at least ejection orifices formed therein on a substrate 1 on which a drive circuit (not shown) for ejecting a liquid, such as an ink, through a plurality of ejection orifices has been formed. For the substrate 1, a wafer composed of single-crystal silicon having a (100) crystal orientation, i.e., a single-crystal silicon substrate, is used. The upper and lower surfaces of the liquid ejection head chip are (100) surfaces, and side surfaces 13-1 to 13-4 are formed into (111) surfaces by anisotropically etching the single-crystal silicon.

The angle formed by the side surfaces 13-2, 13-4 and the upper surface of the substrate 1 is the angle formed by a crystal orientation (100) surface and a crystal orientation (111) surface of the single-crystal silicon, which is 54.74°. The side surfaces 13-1 and 13-3 that oppose the side surfaces 13-2 and 13-4, respectively, are the surfaces formed by anisotropic etching from the lower surface of the substrate, so that the angle will be: 180°−54.74°=125.26°. This means that the two pairs of opposing surfaces have angles that are supplementary to each other.

To form a full-line type ink-jet recording head, placing the liquid ejection head chips by butting the illustrated opposing sides of the liquid ejection head chips makes it possible to butt the side surfaces against each other, the angles of which formed along the crystal orientation of the single-crystal silicon are supplementary to each other. Thus, butting the side walls having the angles that are supplementary to each other permits accurate butting placement with not only high two-dimensional accuracy but also with high accuracy of the orientations of the surfaces through which an ink is ejected.

In the example illustrated in FIG. 1A to FIG. 1C, all the four sides of the rectangular plane of the substrate 1, i.e. all the four side surfaces of the substrate 1, have the (111) surfaces having the supplementary angles; however, the present invention is not limited to the configuration. More specifically, the present invention is applicable insofar as the side surfaces of at least one combination of the two combinations of opposing side surfaces of the substrate have the supplementary angle relationship described above. Thus, only the combination of the side surfaces 13-1 and 13-2 or only the combination of the side surfaces 13-3 and 13-4 illustrated in FIG. 1A to FIG. 1C may have the foregoing relationship of the side surfaces.

To form the side surfaces of the substrate into the silicon crystal (111) surfaces, a method can be used, in which anisotropic etching for producing (111) surfaces is carried out on the silicon single crystal, which has a (100) crystal orientation, at predetermined positions of the substrate.

The following will describe an example of the manufacturing process of the liquid ejection head chip in accordance with the present invention with reference to the cross sectional views given in FIG. 2A to FIG. 2H.

First, a common substrate la made of a single-crystal silicon wafer having a 200-mm diameter and a 725-μm thickness, on which heat generating elements and drive circuits (not shown) have been formed at predetermined positions of the wafer, is prepared. The heat generating elements and the drive circuits have been built in the common substrate la beforehand such that many liquid ejection head chips can be taken from the common substrate 1*a*. FIG. 2A to FIG. 2H illustrate a part that includes the mutually adjoining side surfaces of two liquid ejection head chips in the common substrate 1*a*. First, referring to FIG. 2A, an interlayer 2 for improving the adhesion of an ejection orifice member, which will be formed later, is deposited on each of the upper surface and the lower surface of the common substrate 1*a*. The interlayers 2 function also as the etching masks when liquid supply ports are formed and the side surfaces of the liquid ejection head chips are formed in later process steps. The interlayers 2 can be formed by appropriately selecting a spin coat process, a slit coat process or the like according to a desired film thickness or depositing conditions.

Figure 2A:
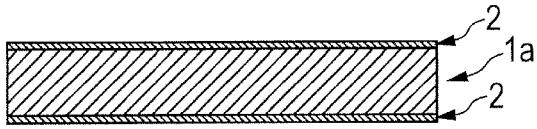
FIGS. 2A, 2B, 2C, 2D, 2E, 2F, 2G, and 2H are process drawings illustrating an example of a method for manufacturing the liquid ejection head chip in accordance with the present invention.
Figure 2B:
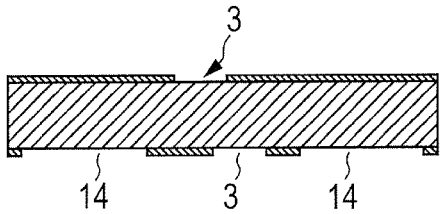

Subsequently, as illustrated in FIG. 2B, etching mask patterns having openings 3, which will be necessary for forming the side surfaces of the liquid ejection head chips, are formed on the surfaces of the interlayers 2. At this time, an etching mask pattern also having the openings and an etching mask pattern having openings 14 for forming liquid supply ports 10 for supplying a liquid to be ejected are simultaneously formed on the back surface of the common substrate 1*a*.

The opening 3 in the front surface of the common substrate 1*a* is used for forming one of the opposing side surfaces of the liquid ejection head chip, while the opening 3 in the back surface of the common substrate 1*a* is used for forming the other of the opposing side surfaces. These side surfaces are denoted by the side surfaces 13-1 and 13-2, respectively, in FIG. 2H.

Figure 2C:
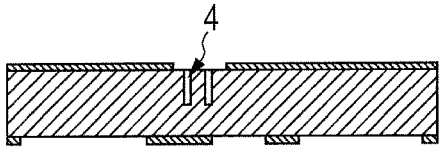
Figure 2D:
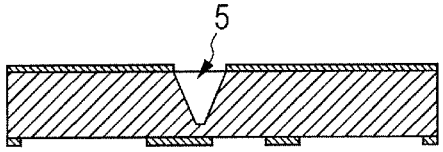

Subsequently, as illustrated in FIG. 2C, guide holes 4 for forming the side surfaces of the liquid ejection head chip are formed, by laser processing, in the region of the opening 3 in the front surface of the common substrate 1*a*. Thereafter, by anisotropically etching the single-crystal silicon, a processing groove 5 for forming the side surface of the liquid ejection head chip is formed in the upper surface of the common substrate 1*a* to a position in the middle of the thickness of the common substrate 1*a*. At this time, it is required to form an anti-etching protective film made of cyclized rubber or the like on the back surface so as to protect the silicon surface of the openings 3 and 14 from being exposed.

Figure 2E:
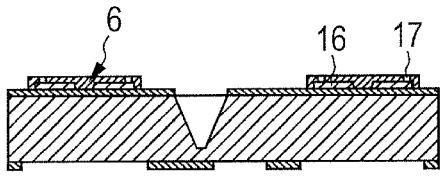

Subsequently, as illustrated in FIG. 2E, the ejection orifice members 6 having at least the flow paths and ejection orifices 17 are deposited on the common substrate 1*a*. There is no particular restriction on the fabrication process for the ejection orifice members 6, so that a fabrication process selected according to the configuration of the ejection orifice members 6 may be used.

Figure 2F:
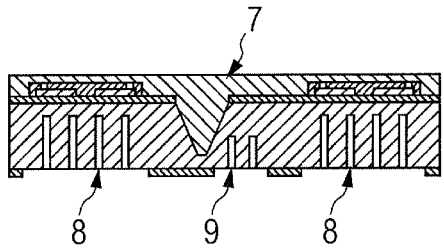

Subsequently, as illustrated in FIG. 2F, guide holes 8 for forming the liquid supply ports 10 and guide holes 9 for forming a processing groove 11 for forming the side surfaces of the liquid ejection head chip are formed in the back surface of the common substrate 1*a* by laser processing. At the time of the laser processing, adjusting the forming conditions of the guide holes, including the quantity, the positions, the width and the depth makes it possible to form the liquid supply ports 10 and the processing groove 11 at the same time by anisotropic etching. The processing groove 11 is formed to a position in the middle of the thickness of the common substrate 1*a*.

The forming conditions, such as the quantity, the positions, the width, and the depth, of the guide holes 4 and 9 are set so as to allow the processing grooves 5 and 11 of desired shapes to be formed to depths that do not penetrate the common substrate 1*a*. The guide holes are preferably formed to depths that are smaller than the depths of the processing grooves and to positions that allow the (111) surfaces of desired shapes and sizes to be formed in the processing grooves. Further, the depths and the positions of the processing grooves 5 and 11 are preferably set such that the (111) surfaces formed in the processing grooves will become the opposing side surfaces used for the direct butting of the separated liquid ejection head chips. For example, in the example illustrated in FIG. 2G, the processing grooves 5 and 11 are formed to the depths that exceed 50% of the thickness of the common substrate la and do not penetrate the common substrate la, making one surface 5*b* in the processing groove 5 and one surface 11*a* in the processing groove 11 oppose each other in the common substrate 1*a*.

The thickness of the common substrate to be left at the positions where the processing grooves are to be formed may be such that the thickness allows the common substrate to maintain its form until the respective liquid ejection head chips are cut to be separated by dicing or the like and also to permit the cutting by dicing or the like. The depths of the guide holes can be set by considering mainly the desired depths of the processing grooves and the etching rate for forming the processing grooves.

An etching stopper layer or layers composed of a material, such as $SiO_2$ or SiN, may be provided beforehand in correspondence with the positions, at which the processing grooves are to be formed, on the opposite side or sides from the front surface and/or the back surface of the common substrate. Providing the etching stopper layers makes it possible to prevent the processing grooves from penetrating the common substrate while forming the processing grooves.

Figure 2G:
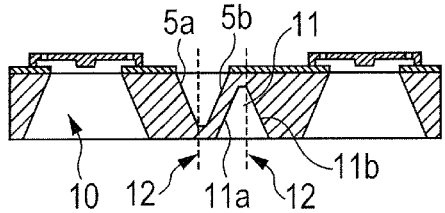

After the liquid supply ports 10 and the processing groove 11 are formed, the liquid ejection head chips are cut into separate chips by dicing or the like. At this time, cutting lines 12 of the liquid ejection head chips illustrated in FIG. 2G are used as the indicators of the cutting positions, and a dicing blade is to be positioned on the side surfaces of the liquid ejection head chips when cutting the chips apart. Cutting the chips apart at the cutting lines 12 makes it possible to leave, as the side surfaces when each liquid ejection head chip is taken out, the surfaces among the (111) surfaces of the single-crystal silicon surface orientation in the processing groove 5 and the processing groove 11 previously formed, which surfaces are desired opposing side surfaces having a desired supplementary angle relationship.

Figure 2H:
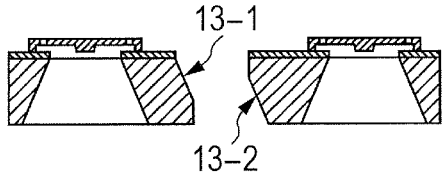

By carrying out the steps of the process described above, the side surfaces 13-1 and 13-2 illustrated in FIG. 2H can be obtained in each liquid ejection head chip separated and taken out of the common substrate. These side surfaces have the supplementary angle relationship in the present invention. The combination of the side surfaces 13-1 and 13-2 illustrated in FIG. 1B can be obtained by the cutting at the cutting lines 12. To obtain the combination of the side surfaces 13-3 and 13-4 illustrated in FIG. 1C, the steps illustrated in FIG. 2A to FIG. 2H are carried out to form the combination of the opposing side surfaces of the liquid ejection head chips along the direction in which the ejection orifices are arranged. Further, for all the side surfaces of the liquid ejection head chips, i.e. both combinations of the opposing side surfaces, to obtain a desired supplementary angle relationship, the side surfaces may be formed according to the process illustrated by FIG. 2A to FIG. 2H at the positions where the side surfaces are to be formed.

By setting the two adjacent cutting positions indicated by the cutting lines 12 close to each other, the portion to be removed by the cutting can be minimized, thus permitting higher material use efficiency.

The process described above completes the liquid ejection head chip in accordance with the present invention that makes it possible to butt the side surfaces of the crystal orientation of (111) against each other when butting the chips in a subsequent step, rather than butting the surfaces that have been cut by dicing.

An alkaline solution may be used for the anisotropic etching for forming the processing grooves for forming the side surfaces of the liquid ejection head chips. Any alkaline solution may be used insofar as the alkaline solution is capable of acting on the silicon single-crystal (100) surfaces to form etched (111) surfaces. As the alkaline solution, an aqueous solution of, for example, tetramethylammonium hydroxide (TMAH) or potassium hydroxide (KOH) may be used. The concentration is preferably set to 5 percent by mass or more and 30 percent by mass or less in the case of, for example, a TMAH aqueous solution.

Alternatively, a dry etching process, such as a reactive ion etching process, may be used. However, the anisotropic etching with an alkaline solution is preferable for successful formation of the (111) surfaces.

Referring to the steps illustrated in FIG. 2A to FIG. 2H, the process for building the chip arrays composed of arranged liquid ejection head chips on the upper surface, which is formed of the (100) surface, of the common substrate 1*a* composed of a silicon single crystal includes a step of incorporating heat generating elements serving as ejection energy generating elements, electric wiring, drive elements and the like in a common substrate, a step of forming an ejection orifice member having ejection orifices and flow paths, and a step of forming liquid supply ports. These steps are not limited to the steps illustrated in FIG. 2A to FIG. 2H and may be changed according to the design of a liquid ejection unit. Further, the step of forming the processing grooves for forming the side surfaces of the liquid ejection head chips is incorporated in the step of building the chip arrays in the example illustrated in FIG. 2A to FIG. 2H. However, the incorporation of the step of forming the processing grooves may be also changed according to the manufacturing process of a liquid ejection head chip of a desired configuration.

Figures 1, 3B:
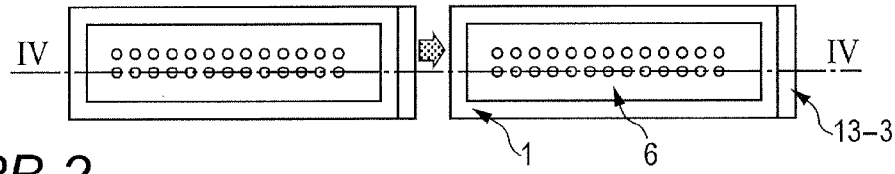
Figures 2, 3B:
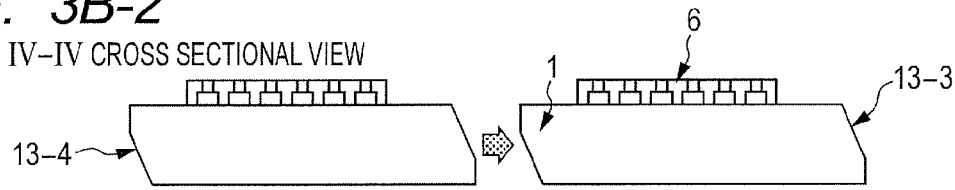
Figures 3, 3B:
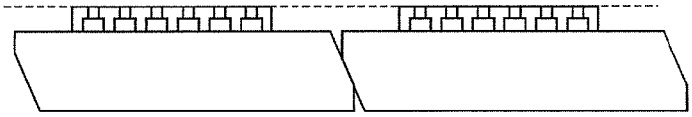
Figures 1, 3C:
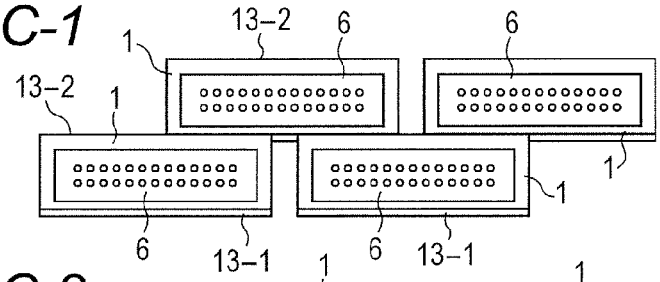
Figures 2, 3C:
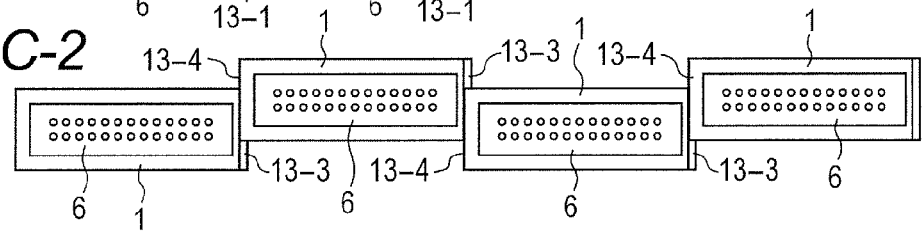

The liquid ejection head chips can be arranged by directly butting the liquid ejection head chips obtained as described above. For example, as illustrated in the plan view of FIG. 3B-1 and the cross-sectional views taken at IV-IV of FIG. 3B-2 and FIG. 3B-3, the liquid ejection head chips can be arranged in series in the longitudinal direction (in the direction of the ejection orifice arrays) by directly butting the opposing side surfaces 13-3 and 13-4. Further, as illustrated in the plan view of FIG. 3C-1, the liquid ejection head chips can be arranged in two staggered rows by directly butting at approximately half the portion of each of the side surfaces 13-1 and 13-2 along the longitudinal direction. Further, as illustrated in the plan view of FIG. 3C-2, the liquid ejection head chips can be arranged in one row with the side surfaces in contact of the liquid ejection head chips being staggered from each other by directly butting approximately half the portion of each of the side surfaces 13-3 and 13-4, which intersect in the longitudinal direction. The direct butting of the liquid ejection head chips described above allows the side surfaces of the crystal orientation (111), rather than the surfaces cut by dicing, to be butted against each other. As a result, it is possible to provide a full-line type liquid ejection head with accurately placed ejection orifice arrays in each liquid ejection head chip.

FIRST EXAMPLE

An example of the present invention will now be described with reference to the cross-sectional schematic views given in FIG. 2A to FIG. 2H.

First, a heater board made of a single-crystal silicon wafer having a 200-mm diameter and a 725-μm thickness, on which heat generating elements and drive circuits (not shown) have been formed at predetermined positions to allow many liquid ejection head chips to be obtained, was prepared as a common substrate 1*a*. The interlayers 2 illustrated in FIG. 2A were deposited on the front surface and the back surface of the common substrate 1*a* by a spin coat process. As the material for the interlayers 2, HL-1200CH made by Hitachi Chemical Co., Ltd. was used, and the spinning speed was adjusted to obtain a 3-μm film thickness. The interlayers improve the adhesion between ejection orifice members 6 and the common substrate la and also function as the etching masks at the time of the alkali etching for forming the side walls of liquid ejection head chips (hereinafter referred to as "the nozzle chips") and the alkali etching for forming liquid supply ports. Hence, the interlayers 2 are formed to the same thickness by the spin coat process not only on the front surface but also on the back surface of the common substrate 1*a*.

The interlayers 2 were patterned by dry etching with a fluorocarbon-based gas $CF_4$ by using a positive type resist pattern, which is generally used, as the etching mask. An opening 3 for the alkali etching for forming the side walls of the nozzle chip was formed in the interlayer on the front surface of the common substrate la. Thereafter, another opening 3 for the alkali etching for forming the side walls of the nozzle chip and openings 14 for forming liquid supply ports were formed in the back surface of the common substrate 1*a*.

The measurement results of the opening widths of the openings 3 formed in the front surface and the back surface of the common substrate 1*a* in the foregoing process indicated approximately 560 μm.

Subsequently, guide holes 4 for alkali etching were formed by laser processing in the opening 3 formed in the front surface of the common substrate la. The laser processing cycle was adjusted to set the processing depth of the guide holes 4 to 250 μm.

Thereafter, an etching protective film having a cyclized rubber as the main ingredient thereof was formed on the back surface of the common substrate 1*a* to a film thickness of 20 μm by a spin coat process, and anisotropic alkali etching was carried out from the front surface of the common substrate 1*a*. As the etching solution at this time, an aqueous solution of tetramethylammonium hydroxide of 80° C. and a concentration of 25 wt % was used, and the etching time was 18 hours. By the etching, a processing groove 5 for forming the side walls of the nozzle chip illustrated in FIG. 2D was formed.

After the etching, the cyclized rubber protective film deposited as the protective film on the back surface of the common substrate 1*a* was removed by xylene, the temperature of which was adjusted to 30° C.

Subsequently, a resin layer 16 for making flow paths and foaming chambers to be provided in an ejection orifice member was deposited by the spin coat process. As the resin for the resin layer 16, a positive type Deep-UV resist ODUR made by TOKYO OHKA KOGYO Co., Ltd. was used, and the main speed was adjusted such that the film thickness after application would be 17 μm. The baking temperature after the application was set to 100° C. and the baking time was set to 3 minutes. The measurement result of the thickness of the applied layer at that time indicated 17 μm. The applied layer was patterned by photolithography thereby to form the resin layer 16.

Subsequently, by the spin coat process, the resin layer 16 was coated with a resin for forming the ejection orifice member 6. As the resin for forming the coating layer, a negative-type resist SU-8 made by Kayaku Microchem Co., Ltd. was used. At this time, the main speed was adjusted such that the thickness of the coating layer would be 30 μm. The baking temperature of the coating layer was set to 150° C. and the baking time was set to 60 minutes. Further, the coating layer was patterned by photolithography and ejection orifices 17 were formed at predetermined positions. Thus, the ejection orifice member 6 illustrated in FIG. 2E was formed.

Then, a protective film 7 composed of cyclized rubber was formed by the spin coat process on the front surface of the common substrate 1*a*. The spin speed was adjusted such that the thickness of the protective film 7 would be 50 μm.

Thereafter, as illustrated in FIG. 2F, guide holes 9 for alkali etching and guide holes 8 for the alkali etching for forming liquid supply ports were formed by laser processing from the back surface of the common substrate 1*a*. The laser processing was controlled such that the guide holes 9 would be 250 μm deep, as with the guide holes 4 formed in the front surface of the common substrate 1*a* in the previous step and that the guide holes 8 would be 400 μm deep.

Properly setting the positions and the depths of the guide holes beforehand makes it possible to form the opening pattern of processing grooves of different depths by a single alkali etching process. The forming conditions, including the positions, the quantity and the depths of the guide holes, can be changed, when appropriate, according to desired cross-sectional shapes and processing depths.

Subsequently, anisotropic alkali etching was carried out from the back surface of the common substrate 1*a*. As with the processing of the front surface of the common substrate 1*a*, a tetramethylammonium hydroxide solution of 80° C. and a concentration of 25 percent by mass was used as the etching solution, and the etching time was 18 hours. By this processing, a processing groove 11 for forming the side walls of the nozzle chip and liquid supply ports 10 illustrated in FIG. 2G were formed.

Thereafter, the chip was diced at cutting lines 12 indicated by the dashed lines in FIG. 2G. The dicing at this time is controlled such that a dicing blade enters at the plane orientation of the (111) surface of the single-crystal silicon exposed by the patterning for forming the side walls of the nozzle chip previously formed.

Thus, the chip side wall after the processing has the single-crystal silicon (111) surface thereof exposed as illustrated in FIG. 2H. Further, the single-crystal silicon (111) surface on the side wall of the opposing chip on the opposite side can be also exposed. Hence, when butting the nozzle chips, the silicon (111) surfaces having angles that are supplementary to each other can be accurately butted, allowing the chips to be accurately butted against each other in an XY direction and also the nozzle surfaces, through which inks are ejected, to be accurately butted against each other.

The liquid ejection head chip in accordance with the present invention can be used with a full-line type ink-jet head for an ink-jet recording system.

Opposing side surfaces of a liquid ejection head chip in accordance with the present invention are formed to be silicon crystal (111) surfaces, and the angles of inclination of the side surfaces are supplementary to each other. As a result, when fabricating a full-line type ink-jet recording head by arranging a plurality of liquid ejection head chips, the positions of the ejection orifices in the face surfaces of the liquid ejection head chips can be easily matched with high accuracy by using the aforesaid side surfaces as direct butting surfaces. This makes it possible to achieve a full-line type ink-jet recording head capable of forming images with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-123747, filed Jun. 12, 2013, which is hereby incorporated by reference herein in its entirety.

What is claimed is:

1. A liquid ejection head chip comprising: a liquid ejection unit having a plurality of ejection orifices for ejecting a liquid, a flow path in communication with the ejection orifices, and an energy generating element that generates energy for ejecting the liquid, the liquid ejection unit being provided on an upper surface formed of a (100) surface of a silicon single-crystal substrate, wherein side surfaces in at least one combination of two combinations of opposing side surfaces of the substrate have (111) surfaces of silicon single crystal and the angles of the (111) surfaces relative to the (100) surface are supplementary to each other.

2. The liquid ejection head chip according to claim 1, wherein, in each of the two combinations of opposing side surfaces of the liquid ejection head chip, the opposing side surfaces are composed of silicon crystal (111) surfaces and the angles of the silicon crystal (111) surfaces of the opposing sides surfaces relative to the (100) surface are supplementary to each other.

3. The liquid ejection head chip according to claim 1, wherein the silicon crystal (111) surfaces are formed by anisotropic etching.

4. The liquid ejection head chip according to claim 3, wherein the anisotropic etching is carried out by using an alkali solution.

* * * * *